US005772186A

United States Patent [19]

Parker

[11] Patent Number: 5,772,186

[45] Date of Patent: Jun. 30, 1998

[54] FENCE EMPLOYING UNIFORM L-SHAPED FLAT SIDED GALVANIZED STEEL POSTS AND FLAT SIDED RAILS

[76] Inventor: Alton B. Parker, 4141 S. Braeswood, Apt. No. 607, Houston, Tex. 77025-3339

[21] Appl. No.: 837,899

[22] Filed: Apr. 22, 1997

[51] Int. Cl.[6] ..... E04H 17/14

[52] U.S. Cl. ..... 256/65; 256/24; 256/59; 256/71; 256/73; 135/119

[58] Field of Search ..... 256/1, 21, 24, 256/27, 28, 29, 45, 59, 60, 62, 65, 71, 73, DIG. 4, DIG. 5; 160/383, 384, 389, 390, 400, 403, 351; 135/119, 114, 115, 120.3, 120.4, 907

[56] References Cited

U.S. PATENT DOCUMENTS

| | | | |
|---|---|---|---|
| 155,526 | 9/1874 | Lane | 256/71 X |
| 311,693 | 2/1885 | Vanbriggle | 256/DIG. 4 X |
| 353,741 | 12/1886 | Fay | 256/62 |
| 694,084 | 2/1902 | Zent . | |
| 720,077 | 2/1903 | Simmons . | |
| 1,426,469 | 8/1922 | Fitch et al. | 256/73 X |
| 1,438,777 | 12/1922 | Nass | 160/390 |
| 2,295,271 | 9/1942 | Schuck | 256/24 |
| 2,573,239 | 10/1951 | Barrett . | |
| 2,599,141 | 6/1952 | Taylor | 135/115 X |
| 2,642,269 | 6/1953 | Daniel . | |
| 2,740,613 | 4/1956 | Berliner | 256/24 X |
| 2,809,017 | 10/1957 | Wong | 256/73 |
| 3,101,929 | 8/1963 | Dvore . | |
| 3,305,221 | 2/1967 | Kling . | |
| 3,383,819 | 5/1968 | Zimmer et al. . | |
| 4,006,730 | 2/1977 | Keklak et al. | 135/119 X |
| 4,063,714 | 12/1977 | Kirkwood . | |
| 4,140,298 | 2/1979 | Coleman, Jr. . | |
| 4,306,631 | 12/1981 | Reusser | 256/73 X |
| 4,369,953 | 1/1983 | Greiner et al. . | |
| 4,852,194 | 8/1989 | Langan | 256/24 X |
| 4,917,543 | 4/1990 | Cole et al. | 256/73 X |
| 5,076,545 | 12/1991 | Bodzin | 256/29 X |
| 5,277,408 | 1/1994 | Parker . | |

FOREIGN PATENT DOCUMENTS

| | | |
|---|---|---|
| 2129845 | 5/1984 | United Kingdom . |

*Primary Examiner*—Kenneth J. Dorner
*Assistant Examiner*—Bruce A. Lev
*Attorney, Agent, or Firm*—Vaden, Eickenroht & Thompson, L.L.P.

[57] ABSTRACT

A fence frame is disclosed that preferably comprises galvanized steel posts that provide an accessible flat surface or surfaces parallel with the surface of the transverse rails and through which are applied holding bolts for securing the post to adjoining ends of rail sections. The posts and rail sections are preferably made of standard length L-shaped galvanized angle irons that are readily available. The rails are stripped at their ends to fit over the posts and to present a flat plane of fence frame parts for the installation of a covering. Such covering can conveniently be paneling secured to the fence rails by self-tapping, self-drilling screws or by flexible galvanized wire tie rods.

9 Claims, 2 Drawing Sheets

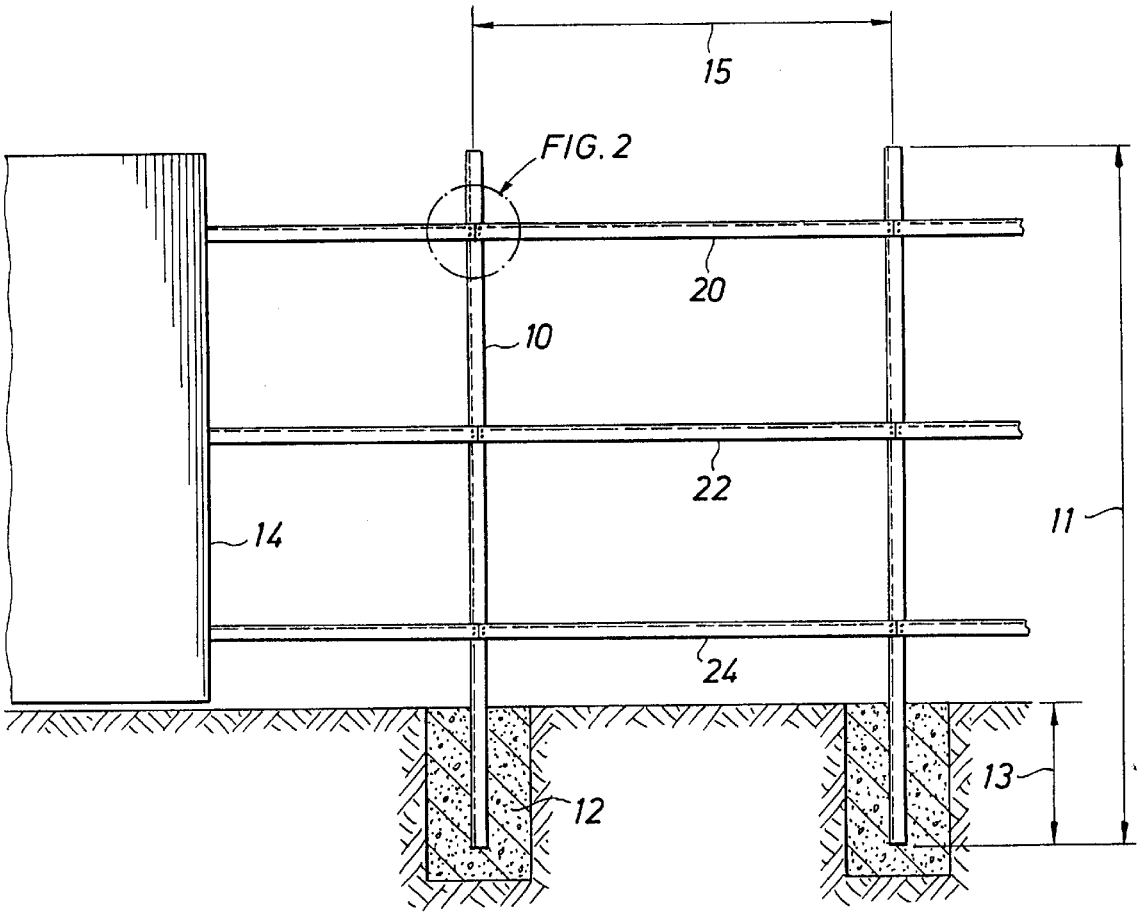
FIG. 1
FIG. 5
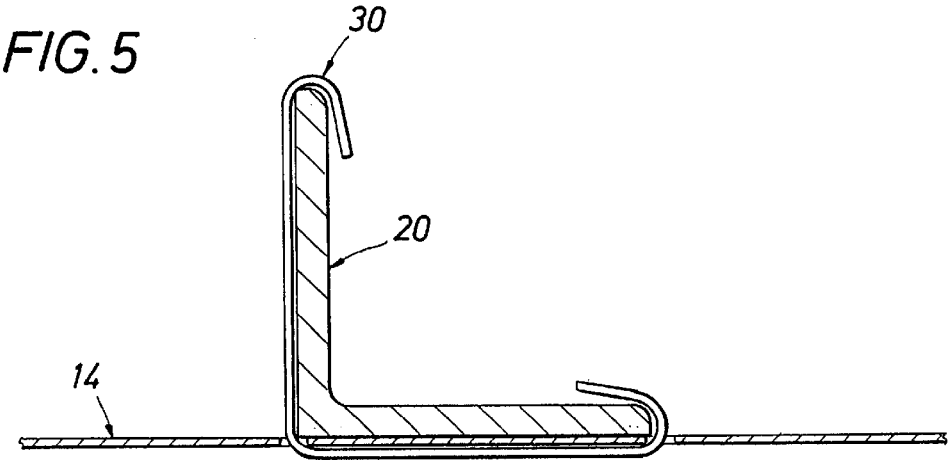

FENCE EMPLOYING UNIFORM L-SHAPED FLAT SIDED GALVANIZED STEEL POSTS AND FLAT SIDED RAILS

BACKGROUND OF THE INVENTION

1. Field of the Invention

This invention pertains to a simple fence construction and particularly to a fence comprising stock or standard parts that are readily prefabricated so that they can be put together by a "do it yourself" fence builder, but resulting in a fence that is durable and aesthetically attractive.

2. Description of the Prior Art

Many fences seen in residential neighborhoods are picket board fences that, except for nails, gate hinges and locks, and possibly underground foundations for the support posts, are all wooden in construction with only the individual pickets and the posts being pre-cut. Although the wood used can vary, cedar is often employed for its long-lasting qualities and relative imperviousness to the ravages of the environment, including termites and the like. Nevertheless, even cedar fences quickly turn gray and the posts deteriorate, especially at the ground line where the posts enter the ground and/or their respective concrete footings. In time, the boards give way at their nail holes and the fences lean, come apart and are generally unsatisfactory as fences. Fences of this type have been known to decay to an unsatisfactory state in only ten or a few more years, requiring substantial repairs or in many cases replacement with new materials.

Longer lasting fences employ metal posts, rather than wooden posts. Although fences having enclosed box channel posts are known, the metal posts used more any other are metal tubing posts. It is possible to completely drill a bolt hole through such metal post. However, the most common connection is to use holding bands or straps that go around the post to be secured at its ends by screws or bolts to the cross piece or rail. It will be evident that such securement allows the post to rotate relative to the rail and for the bands and the attached cross piece to slide up or down or even to pull one way or the other and tear the holes of the band. In short, banding the posts to the rails in accordance with prior procedures has not been very satisfactory.

Bolting to a tubular post is extremely tricky and requires extremely long bolts to go through both sides of the tubular post. Even bolting to an enclosed box channel can be tricky and requires long bolts. In addition, an enclosed box channel often accumulates debris and even trash through its top open end that attracts bugs and, with trash decay, can create unpleasant odors.

Therefore, it is a feature of the present invention to provide an improved frame structure for a fence that is made of standard sized parts that can be pre-fitted for accurate assembly even by a novice fence builder, yet provide a more durable and attractive fence than is commonly on the market.

It is another feature of the present invention to provide an improved frame structure for a fence that is made of substantially the same L-shaped or right angle galvanized iron stock for both the post and rail structures and to provide a substantially flat plane of frame parts for attaching a fence covering to one side of the frame and a structure that employs only relatively short bolts.

It is still another feature of the present invention to provide an improved versatile fence structure that can be employed to mount wooden pickets, sheet metal panels, plastic panels, metal rods, and other fence coverings.

SUMMARY OF THE INVENTION

A fence structure of a preferred embodiment of the invention employs generally uniform L-shaped or right angle galvanized iron stock for both the posts and the rails. A plurality of posts is preferably similarly aligned so that the respective "L" configurations all face in the same direction, there being a common vertical plane in line with a first side of each of the posts. At least a top and bottom rail, and preferably, also an intermediate rail, are comprised of sections spanning the space between the posts and attaching thereto. Preferably, a rail section is oriented to have a flat side that is vertical and, thus, parallel with the in-line flat sides of the posts. The horizontal surface of the ends of the rail sections that are attached to the posts are stripped to allow the ends to overlap with the posts. Aligned bolt holes are provided in the overlapping rail section ends and the posts to accommodate bolts. Both the rail and post bolt holes are smooth and large enough for a bolt to pass therethrough so that a suitable accommodating nut can be screwed onto the bolt to secure the rail section to the post and to present a substantially flat plane for the fence covering.

Preferably, the bolt end not taking the nut would be square inside the flat bolt head so that the square protrusion would fit into a square hole in the post and lock the bolt against rotation. This allows the nut, which could be a wing nut, to be run up and tightened without being held by a wrench.

The fence covering can be almost any type, but can be most efficiently a series of fence panels. Preferably, such panels indicate a plurality of holes spaced horizontally apart along each of the respective rails. In one preferred embodiment, the holes receive self-tapping, self-drilling screws into a rail section behind the holes in a covering panel. Alternately, a panel has a plurality of pairs of holes spaced horizontally apart along such rails such that one hole of each pair is approximately at or just above where the top edge of the related rail section is located and the other hole is at or just below where the bottom edge of the rail section is located. A pair of holes accommodates a flexible tie rod so that the panel can be attached to a rail section at this location without the use of any special tools, even a screw driver.

The fencing material is preferable made up of metal panels, typically panels made of aluminum or sheet steel. However, plastic panels, wooden or plastic pickets or slats, or metal rods or bars can be employed. However, the fencing frame can be marketed separately without any kind of covering material, which could then be provided by purchaser, as desired.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

In the drawings:

FIG. 1 is a front view of a fence in accordance with a preferred embodiment of the invention, the fence covering being only partially shown to reveal the fence frame structure; the base of the posts are shown in cross section.

FIG. 5 is a detail of an alternate preferred embodiment scheme for attaching a panel to a rail.

DESCRIPTION OF PREFERRED EMBODIMENTS

Figure 2:
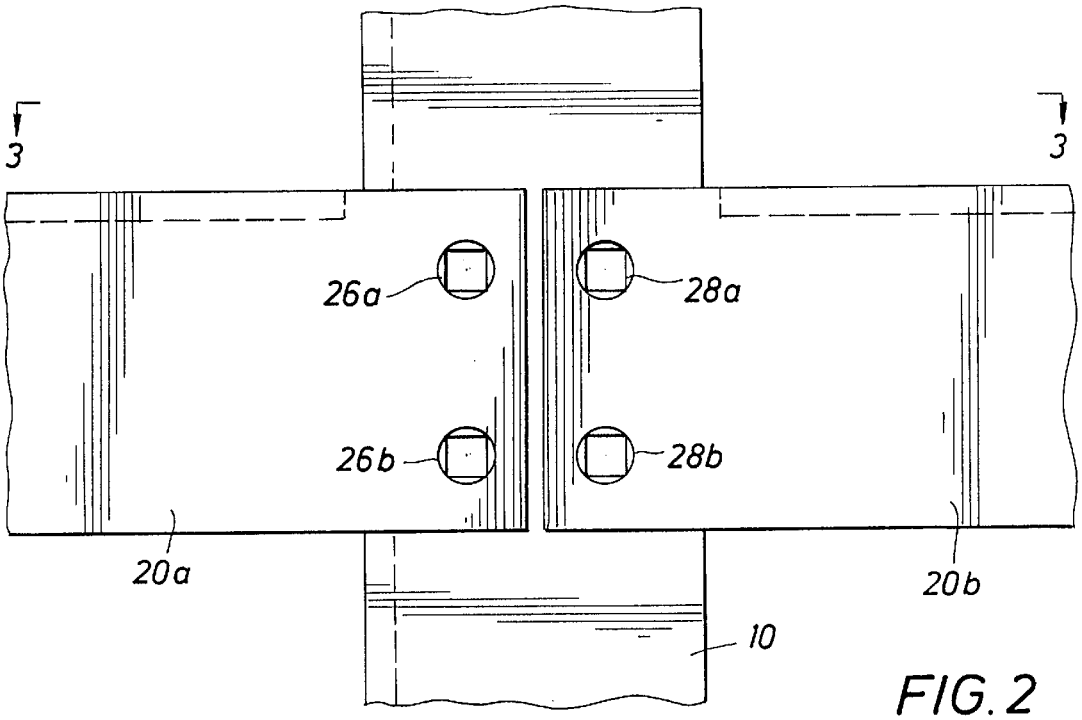
FIG. 2 is a detail view of FIG. 1 at the place where the rails are connected to a post.

Now referring to the drawings, and first to FIG. 1, a fence segment is shown under construction in accordance with the invention. A vertical, galvanized iron, in-line post 10 is shown in the center of the drawing, the bottom or base end of which is anchored in concrete block 12. The block is normally poured in place while the post is supported and may be flush with the ground or slightly below the ground surface. Alternatively, the posts can be installed deeply in the soil by using an impact tool; however, even a deeply driven post may not be as solidly installed as with a concrete foundation block. Fence paneling 14 selected from a wide range of options, as discussed more fully below, is mounted to the fence frame in a manner also discussed below.

FIG. 2 is a detail view of the intersection of a post with the ends of two adjoining rail sections, one from either direction. The detail is shown as an illustration of a portion of the top rail of the fence frame shown in FIG. 1. However, the fence frame will conventionally include a bottom rail of similar structure and, preferably, an intermediate or middle rail, also of similar structure. Thus, the detail of FIG. 2 is really just representative therefor of any post and its two adjoining rail sections. A typical fence frame employs posts 10 that are approximately 10 feet in overall height 11 with the bottom two feet 13 embedded in the concrete block. The posts are typically installed at a center-to-center distance 15 that is about six feet apart, the top rail located about one foot below the top of the posts and the bottom rail located about foot above the ground level. The intermediate rail is located in the center location between the top and the bottom rails.

Figure 3:
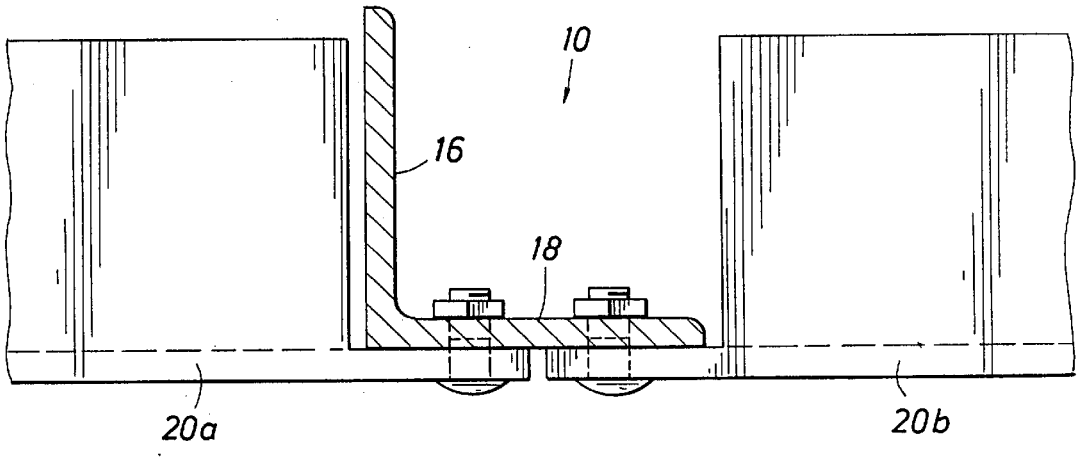
FIG. 3 is a top view of the detail shown in FIG. 2.

Returning to FIG. 2 and to FIG. 3, the top view of FIG. 2, post 10 is shown as an L-shaped or right angle iron having legs 16 and 18 of substantially equal length dimensions. Preferable, the lengths of legs 16 and 18 are two-inches long and the thickness is in a preferred range between ⅛"–3/16", although heavier posts can be employed, if desired. Such angle iron material is standard or stock and is generally readily available, which is an advantage to the fence frame of the present invention. The sections of the rails are also made of the same size angle iron material as the posts.

Assuming that the posts are located approximately six feet apart, the sections of top rail 20, middle rail 22 and bottom rail 24 are six feet in length, again a standard or stock item. In order for the ends of the rail sections to overlap the posts, as shown in FIGS. 2 and 3, the top portion of the ends of sections 20*a* and 20*b* are stripped back or the material is removed from one of the legs about 1-½ inches. Such stripping as illustrated allows the post angle iron to be oriented with leg 18 parallel to the in-line plane of the fence and the vertical portion of the stripped ends of the adjoining rail sections to be in a plane parallel with leg 18, again as shown is FIGS. 2 and 3. It will also be seen that the leg of the end that has been stripped is horizontal to the ground and is positioned on top of the vertically oriented leg. If preferred, however, the horizontal leg could be positioned on the bottom of its vertical leg. In any event, a rail section is stripped at the same leg on each of its two ends.

As shown in FIG. 3, the ends of the rail sections are pre-drilled at holes 26*a*, 26*b*, 28*a* and 28*b* with matching or accommodating holes to allow two bolts 26*a* and 26*b* and 28*a* and 28*b*, vertically aligned to hold each of the rail sections 20*a* and 20*b* to the post. The holes in the posts are preferably squared a short distance and the bolt end not taking the nut includes a matching square protrusion that fits into such a squared hole in the post to lock the bolt against rotation. This allows a nut, which could be a wing nut, to be run up the bolt and tightened without the use of a wrench to hold the bolt in place. A flat or lock washer could also be used, if desired. The bolt heads are larger than the holes to secure the rail sections in place. A 5/16-inch bolt size is preferred. A configuration other than square can be employed for the bolt protrusions and their accommodating holes. Even though the bolt heads protrude slightly from the rail, the fence covering or paneling employed can be readily accommodated thereover without noticeable dimensional difficulty or gap creation between the covering and the rails.

Fence covering 14, which can be any one of numerous structures and material, is popularly a complete or opaque covering. Examples of suitable coverings include metal or plastic sheeting or panels having periodic vertical crimps for structural strength and beauty enhancement. Similar vertical seams can be used to disguise the edges of the sheets and can be used to easily fit over the bolt heads of the bolts that are used to attach the rail sections to the posts, as just described.

Furthermore, if desired, the covering may include a galvanized mesh (not shown), the mesh being fine enough to allow an evergreen vine or other suitable live plant to climb and fill out the mesh. Such mesh can be used in lieu of any other covering and, thus, will provide privacy when the plant has grown and filled in to an adequate amount. The mesh can also be used with another covering so that privacy is immediately obtained, but the plant will enhance the beauty of one or both sides, depending on the location of the mesh and how the plant is encouraged to grow.

Figure 4:
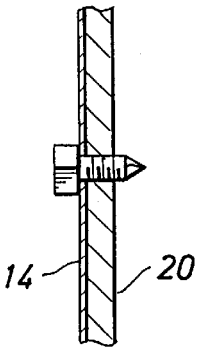
FIG. 4 is a detail view of a preferred embodiment scheme for attaching a panel to a rail.

FIG. 4 illustrates the use of self-tapping, self-drilling screws for joining a sheet of covering 14 to an angle rail 20. The placing of such screws can be determined by the installer and can be employed with respect to all or some of the rails, as desired. Power tools are readily available for driving such screws.

However, paneling can be prepared and installed that does not require any tools, as shown in FIG. 5. Here, holes are pre-drilled in covering 14 at or just above the location of rail 20 and at or just below the location of rail 20. A galvanized wire tie rod 30 that is flexible enough to permit this installation procedure is threaded through the holes, as shown, and looped over the edges of the rail to secure the fence covering to the rail. The specific shape of the tie rod can vary to accomplish the same results.

The preferred method of aligning the posts is to face all of them in the same direction; however, alternating directional alignment can be employed, as desired, just so long as an in-line surface of the respective posts is presented for paneling or covering in the manner just described.

It will be apparent that the construction technique and material is stock and available for installation even by someone who is not particularly skilled and with a minimum of materials and tools. Thus, the structure is particularly suited for the "do-it-yourself" builder. However, because the frame can accept a fencing material of almost any description, it is useful as the basis for being covered with aluminum sheet panels, wood pickets, plastic pickets, metal rods or many other coverings. Many of such coverings are available that would not support a fire and, therefore, unlike a common cedar fence, are much safer from a fire prevention point of view.

While several embodiments of the invention have been shown and other variations described, it will be understood that the invention is not limited thereto. Many modifications may be made and will become apparent to those skilled in the art.

What is claimed is:

1. A fence comprising:

a plurality of posts, each of said posts consisting essentially of a single vertical, elongate piece of galvanized iron having an L-shaped transverse cross section, said posts aligned with respect to one another to present in-line a flat outside surface of each of said posts for the attachment of rails, at least a bottom and a top horizontal rail comprised of multiple sections of galvanized iron, each section having an L-shaped transverse cross section, the sections of each of said horizontal rails being in end-to-end alignment to produce a vertical outside flat surface and a horizontal flat surface, a horizontal flat surface end portion of at least one end of each of said multiple sections being stripped to allow overlap of the resulting exposed vertical end portion with an attachment area of one of said posts, each of said exposed vertical end portions and corresponding attachment areas of said posts including aligned bolt holes, bolts for attaching said exposed vertical end portions to said posts through said aligned bolt holes, and a fence covering attachable to said rails.

2. A fence in accordance with claim 1, wherein the L-shaped transverse cross section of said posts are uniformly positioned.

3. A fence in accordance with claim 1, and including an intermediate rail between said bottom and top rails.

4. A fence in accordance with claim 1 or 3, wherein said horizontal flat surfaces of said sections of said rails merge with the respective vertical flat surfaces of said sections of said rails at the respective tops thereof.

5. A fence in accordance with claims 1 or 3, wherein each of said bolts includes a square protrusion underneath its head and wherein said bolt holes in said posts are at least partially squared to accomodate said square protrusions to prevent rotation of said bolts during installation.

6. A fence in accordance with claims 1 or 3, and including nuts for attaching with said bolts.

7. A fence in accordance with claims 1 or 3, wherein said fence covering includes paneling and self-tapping, self-drilling screws for attaching said paneling to said rails.

8. A fence in accordance with claims 1 or 3, wherein said fence covering includes horizontally spaced apart pairs of two vertically separated holes approximately opposite the top and bottom of each of said rails and including a flexible tie rod for each pair of said holes for attaching said fence covering to a respective one of said rails.

9. A fence frame comprising:

a plurality of posts, each of said posts consisting essentially of a single vertical, elongate piece of galvanized iron having an L-shaped transverse cross section, said posts aligned with respect to one another to present in-line a flat outside surface of each of said posts for the attachment of rails, at least a bottom and a top horizontal rail comprised of multiple sections of galvanized iron, each section having an L-shaped transverse cross section, the sections of each of said horizontal rails being in end-to-end alignment to produce a vertical outside flat surface and a horizontal flat surface, a horizontal flat surface end portion of at least one end of each of said multiple sections being stripped to allow overlap of the resulting exposed vertical end portion with an attachment area of one of said posts, each of said exposed vertical end portions and corresponding attachment areas of said posts including aligned bolt holes, and bolts for attaching said exposed vertical end portions to said post through said aligned bolt holes.

* * * * *